US005549255A

United States Patent [19]

Huang

[11] Patent Number: 5,549,255

[45] Date of Patent: Aug. 27, 1996

[54] SILENCER FOR TAPE DISPENSER

[76] Inventor: Harrison Huang, No. 23, Lin T'So Rd.,, Shengkang, Taichung Hsien, Taiwan

[21] Appl. No.: 419,552

[22] Filed: Apr. 10, 1995

[51] Int. Cl.[6] ..... B32B 31/00

[52] U.S. Cl. ..... 242/422.5; 242/588; 156/579

[58] Field of Search ..... 242/422.5, 588; 156/577, 579

[56] References Cited

U.S. PATENT DOCUMENTS

| | | | |
|---|---|---|---|
| 3,131,109 | 4/1964 | Auld et al. | 156/579 |
| 3,972,769 | 8/1976 | Lissoni | 156/579 |
| 5,110,401 | 5/1992 | Huang | 156/579 |
| 5,125,589 | 6/1992 | Manusch | 242/538.1 |
| 5,236,540 | 8/1993 | Shi | 156/579 |
| 5,393,367 | 2/1995 | Yu Chen | 156/579 |

FOREIGN PATENT DOCUMENTS

| | | | |
|---|---|---|---|
| WO89/00968 | 2/1989 | WIPO | 242/422.5 |

*Primary Examiner*—John P. Darling
*Attorney, Agent, or Firm*—Browdy and Neimark

[57] ABSTRACT

A silencer for a tape dispenser comprises a fixation shaft fastened at one end thereof with a base plate of the tape dispenser, a swiveling stand fastened pivotally at one end thereof with the fixation shaft, a rotating shaft fastened pivotally with another end of the swiveling stand, a rolling cylinder fitted rotatably over the fixation shaft, and a resilient element fastened at one end thereof with the fixation shaft and at another end thereof with the swiveling stand for providing an elastic force enabling the rotating shaft to remain in contact with the surface of the tape roll all the time.

5 Claims, 4 Drawing Sheets

SILENCER FOR TAPE DISPENSER

FIELD OF THE INVENTION

The present invention relates generally to a tape dispenser, and more particularly to a device capable of deadening the noise which is made at such time when the tape dispenser is at work to dispense the tape.

BACKGROUND OF THE INVENTION

As shown in FIG. 1, a tape dispenser 10 of the prior art comprises a hand grip 11, a base plate 12 fastened to one side of the hand grip 11, a cutter 13 disposed in front of the base plate 12, and a tape mount 14 disposed behind the base plate 12. In operation, the tape 151 of a tape roll 15 received by the tape mount 14 is pulled through the roller 131 located under the cutter 13. The tape 151 of a desired length is cut by the cutter 13. It is a common occurrence that the noise is made when the tape 151 is pulled. Such noise as made by the tape dispenser 10 of the prior art is a nuisance at best.

SUMMARY OF THE INVENTION

It is therefore the primary objective of the present invention to provide a tape dispenser with a silencer capable of deadening the noise when the tape is pulled for dispensation.

The foregoing objective of the present invention is attained by a silencer for a tape dispenser, which comprises a fixation shaft fastened at one end thereof with a base plate of the tape dispenser, a swiveling stand fastened rotatably at one end thereof with the fixation shaft, a rotating shaft fastened pivotally with another end of the swiveling stand, a rolling cylinder fitted rotatably over the fixation shaft, and a resilient element fastened at one end thereof with the fixation shaft and at another end thereof with the swiveling stand for providing an elastic force enabling the rotating shaft to remain in contact with the surface of the tape roll all the time.

DETAILED DESCRIPTION OF THE INVENTION

Figure 1:
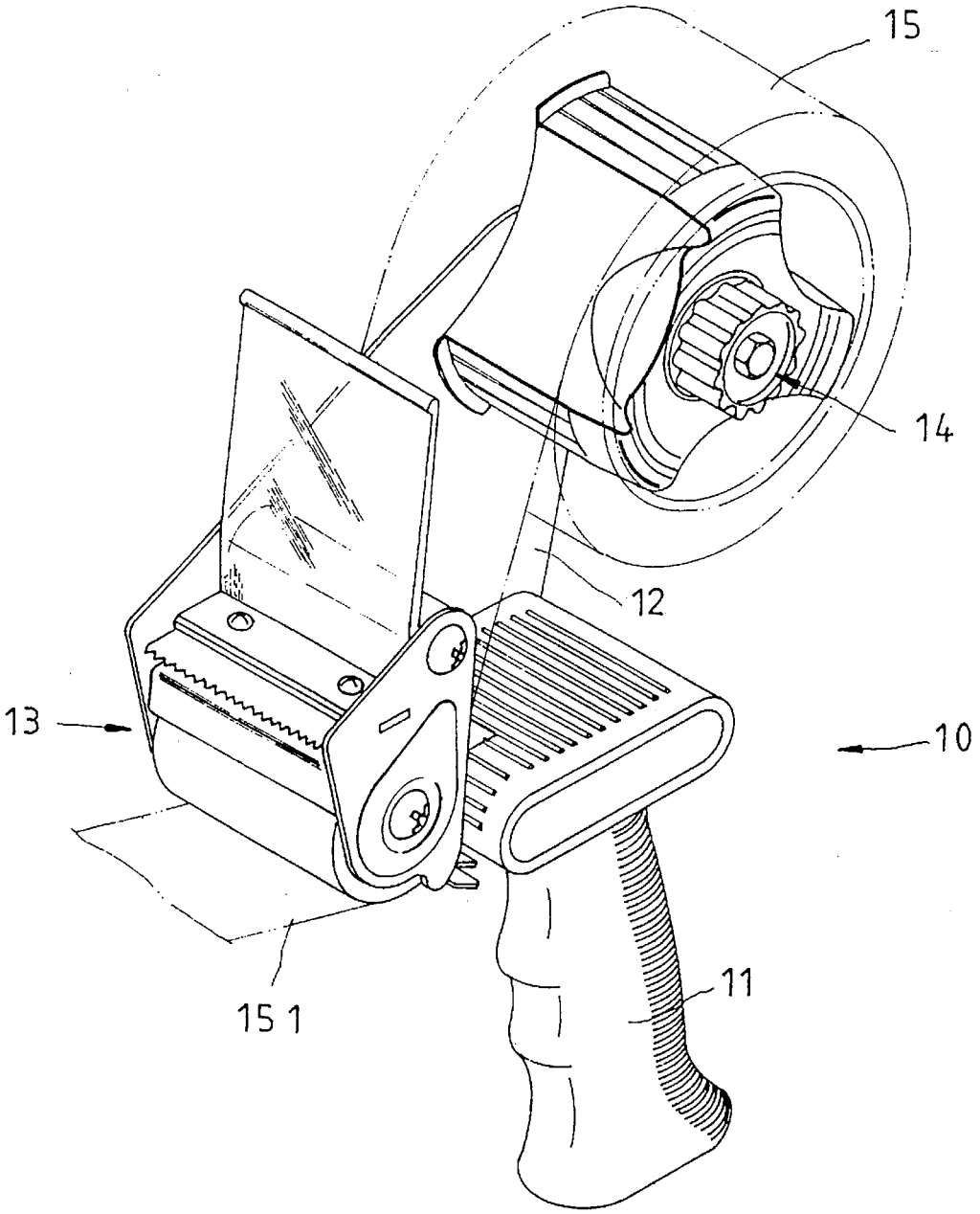
FIG. 1 (PRIOR ART)
FIG. 1 shows a perspective view of a tape dispenser of the prior art.
Figure 2:
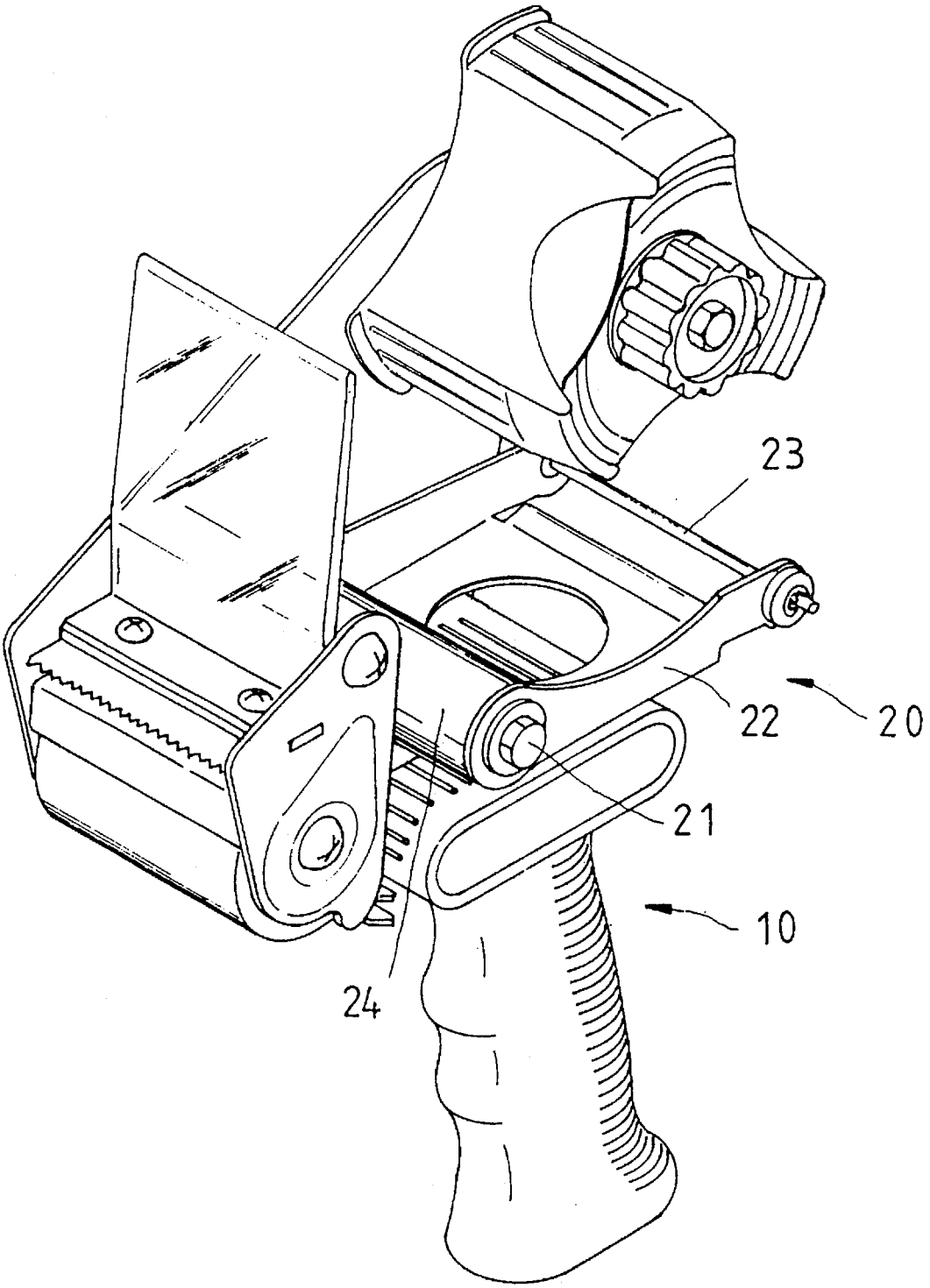
FIG. 2 shows a perspective view of a preferred embodiment of the present invention.
Figure 3:
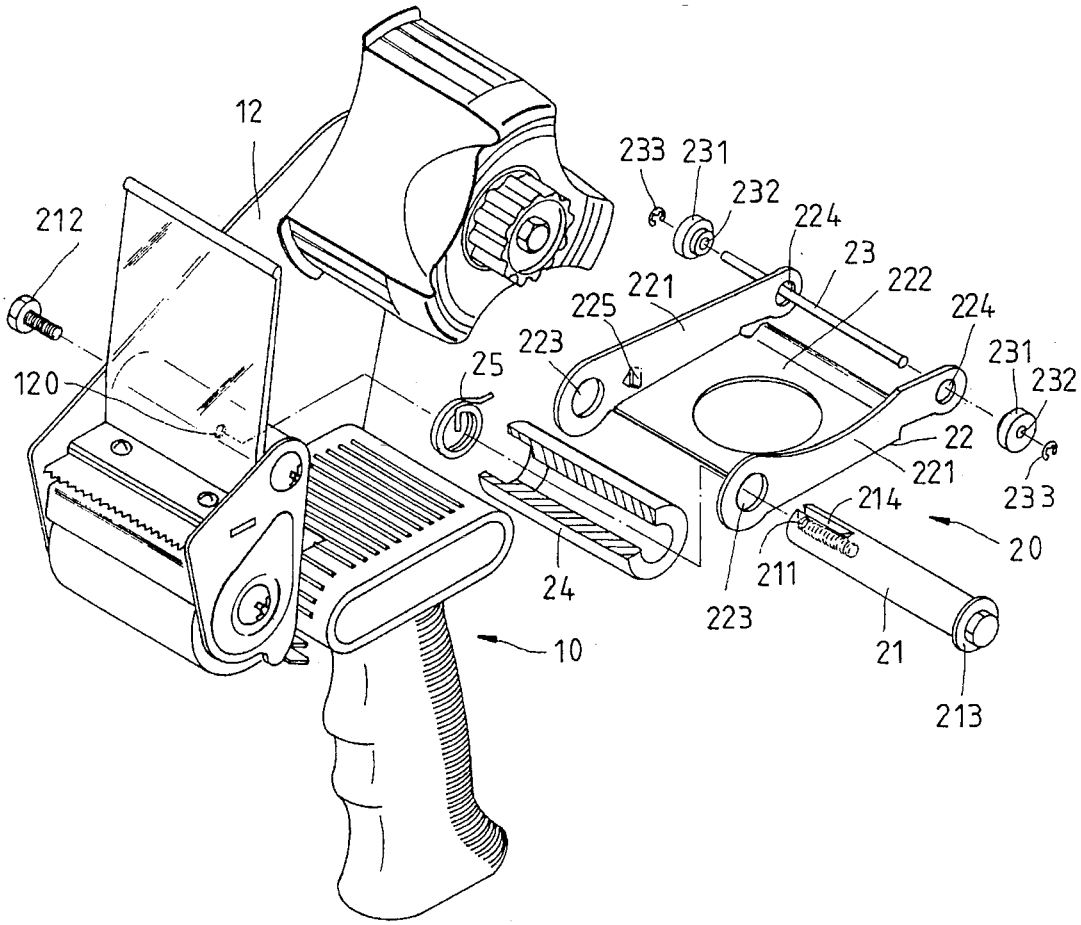
FIG. 3 shows an exploded view of the preferred embodiment of the present invention.
Figure 4:
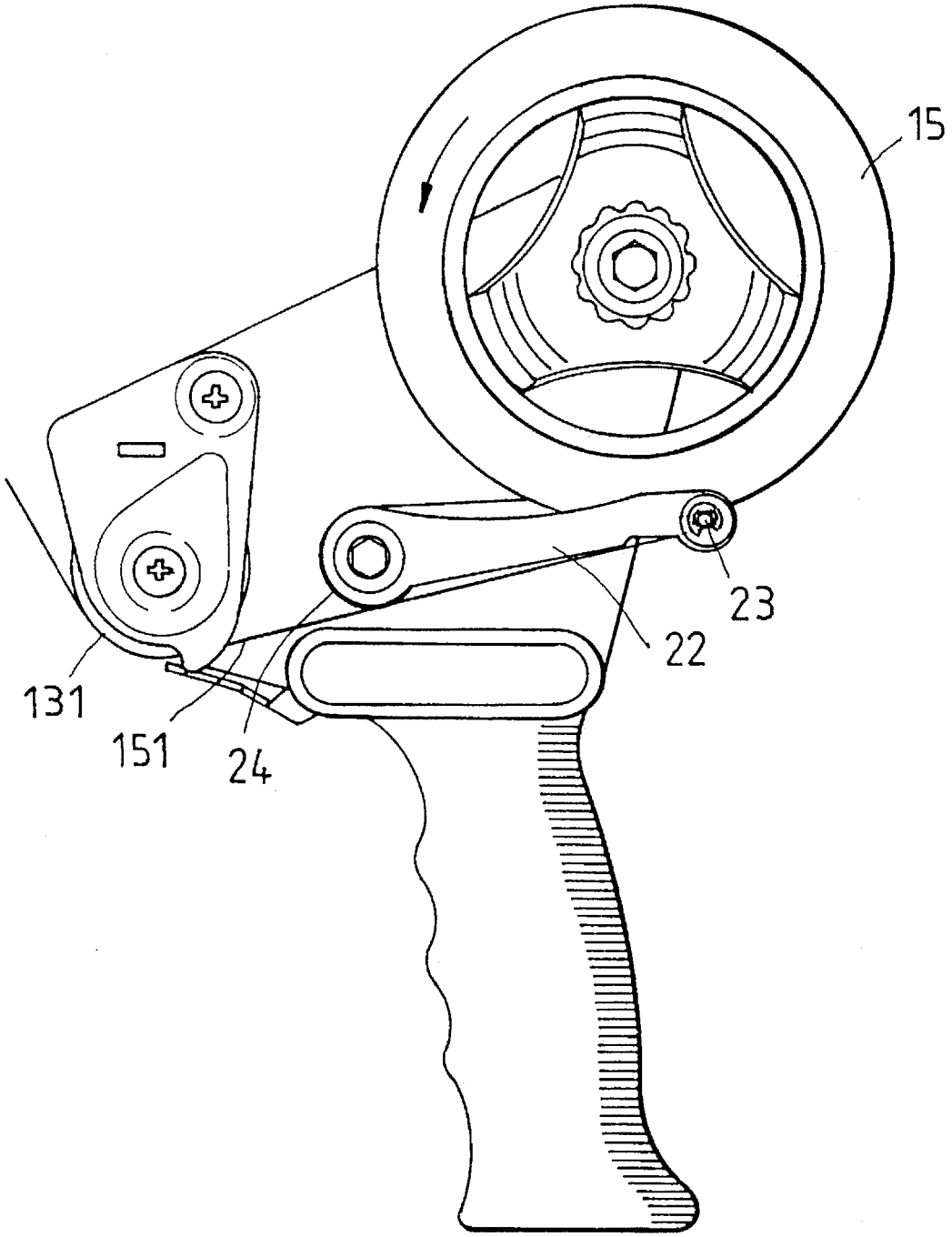
FIG. 4 shows a schematic view of the present invention at work.

As shown in FIGS. 2–4, a silencer 20 of the present invention is intended for use in a tape dispenser 10 and is composed of the component parts which are described explicitly hereinafter.

A fixation shaft 21 is fastened horizontally at one end thereof with a base plate 12 of the tape dispenser 10 and is provided at one end thereof with a threaded hole 211. The base plate 12 is provided with a through hole 120 located between a cutter 13 and a receiving mount 14. The fixation shaft 21 is retained securely by a bolt 212 which is engaged with the threaded hole 211 via the through hole 120.

A swiveling stand 22 has two parallel arms 221 connected by a connection piece 222. The two arms 221 are provided respectively at both ends thereof with through holes 223, 224. The fixation shaft 21 is received in the through hole 223 such that the fixation shaft 21 is fastened rotatably with two arms. The fixation shaft 21 is provided at another end thereof with an arresting portion 213 for preventing the swiveling stand 22 from moving out of place.

A rotating shaft 23 is fastened rotatably in two through holes 224 of another end of the swiveling stand 22. The two through holes 224 are provided respectively with a bearing 231 having a through hole 232 dimensioned to reveive therein the rotating shaft 23 which is retained securely at both ends thereof with a retaining ring 233 of a C-shaped construction.

A rolling cylinder 24 is fitted rotatably over the fixation shaft 21 and is located between the two arms 221 of the swiveling stand 22.

A resilient element 25, which is in fact a torsion spring, is retained at one end thereof in a slot 214 of the fixation shaft 21 and at another end thereof with a projection 225 of the arm 221 of the swiveling stand 22. The resilient element 25 is intended to provide the swiveling stand 22 with an elastic force enabling the rotating shaft 23 to remain in contact with the surface of a tape roll 15.

As illustrated in FIG. 4, a tape 151 of the tape roll 15 is first wound on the rotating shaft 23 and is then pulled in reverse direction to be wound on the rolling cylinder 24 and a rolling wheel 131. The torsion spring 25 serves to enable another end of the swiveling stand 22 to swing upwards. As a result, the rotating shaft 23 is capable of remaining all the time in contact with the surface of the tape roll 15 regardless of the size of the tape roll 15. When the tape 151 of the tape roll 15 is dispensed, the noise is deadened by the tape 151 which is under a tension produced by a pulling force of the tape roll 15 whose surface is pressed by the rotating shaft 23.

What is claimed is:

1. A silencer for a tape dispenser comprising:

a fixation shaft fastened horizontally at one end thereof with a base plate of a tape dispenser;

a swiveling stand fastened pivotally at a first end thereof with said fixation shaft;

a rotating shaft rotatably fastened at a second end of said swiveling stand;

a rolling cylinder fitted rotatably over said fixation shaft; and a resilient element fastened at one end thereof with said fixation shaft and at another end thereof with said swiveling stand for providing an elastic force enabling said rotating shaft to remain at all time in contact with the surface of a tape roll mounted in said tape dispenser.

2. The silencer as defined in claim 1, wherein said swiveling stand comprises two arms parallel to each other and a connection piece connecting said two arms, each of said two arms provided respectively at a first end and a second end thereof with a through hole; wherein said fixation shaft is rotatable in each said through hole located at said first end of each of said two arms; and wherein said rotating shaft is rotatable in each said through hole located at said second end of each of said two arms.

3. The silencer as defined in claim 1, wherein said rotating shaft is provided with a bearing located at a portion thereof at which said rotating shaft is rotatable with said swiveling stand.

4. The silencer as defined in claim 1, wherein said resilient element is a torsion spring.

5. The silencer as defined in claim 1, wherein said rolling cylinder is fitted over said fixation shaft such that said rolling cylinder is located between two arms of said swiveling stand.

* * * * *